US008347662B2

(12) United States Patent
Kaminsky, Jr.

(10) Patent No.: US 8,347,662 B2
(45) Date of Patent: Jan. 8, 2013

(54) SHIELDING ASSEMBLY FOR DOOR LOCK SYSTEM

(76) Inventor: Robert Joseph Kaminsky, Jr., Homer Glen, IL (US)

( * ) Notice: Subject to any disclaimer, the term of this patent is extended or adjusted under 35 U.S.C. 154(b) by 0 days.

(21) Appl. No.: 12/941,171

(22) Filed: Nov. 8, 2010

(65) Prior Publication Data

US 2011/0219830 A1 Sep. 15, 2011

Related U.S. Application Data

(63) Continuation-in-part of application No. 12/722,071, filed on Mar. 11, 2010.

(51) Int. Cl.
*E05B 67/38* (2006.01)

(52) U.S. Cl. ..... 70/56; 70/2; 70/34; 70/417; 70/455

(58) Field of Classification Search ..... 70/7, 8, 70/31–34, 51, 52, 54, 56, 91, 416, 417, 423, 70/455

See application file for complete search history.

(56) References Cited

U.S. PATENT DOCUMENTS

| | | | | |
|---|---|---|---|---|
| 3,996,774 | A * | 12/1976 | Best | 70/32 |
| 5,669,255 | A * | 9/1997 | Albano | 70/56 |
| 6,854,303 | B2 * | 2/2005 | Shiao et al. | 70/56 |
| 7,290,415 | B2 * | 11/2007 | Rosenberg et al. | 70/9 |
| 7,562,546 | B2 * | 7/2009 | Taylor | 70/23 |
| 7,610,784 | B2 * | 11/2009 | Rohde et al. | 70/455 |
| 7,770,422 | B1 * | 8/2010 | Sierra | 70/32 |
| 2004/0011092 | A1 * | 1/2004 | Haczynski et al. | 70/23 |
| 2005/0252257 | A1 * | 11/2005 | Woods et al. | 70/33 |

* cited by examiner

*Primary Examiner* — Christopher Boswell
(74) *Attorney, Agent, or Firm* — Wood, Phillips, Katz, Clark & Mortimer

(57) ABSTRACT

A combination including an apparatus with a frame bounding an internal space and a first repositionable door that is movable between closed and open positions relative to the frame. Cooperating components on the first door and at least one of: a) the frame; and b) a second door are alignable in a first relative position with the first door closed. A lock assembly cooperates with the components with the first door in the closed position and the cooperating components in the first relative position and has a locked state wherein the lock assembly prevents the first door from being moved from its closed position into its open position. A shielding assembly conforms to at least a part of the exposed outer surface, overlies at least a part of the exposed outer surface, and is frictionally held against the lock assembly to be maintained in an operative state.

20 Claims, 16 Drawing Sheets

SHIELDING ASSEMBLY FOR DOOR LOCK SYSTEM

CROSS-REFERENCE TO RELATED APPLICATION

This application is a continuation-in-part of U.S. application Ser. No. 12/722,071 filed Mar. 11, 2010.

BACKGROUND OF THE INVENTION

1. Field of the Invention

This invention relates to lock systems for doors and, more particularly, to a shielding assembly that protects exposed portions of the lock system from moisture, and the like.

2. Background Art

Van-style vehicles are commonly made with a number of doors that can be repositioned, as by sliding and/or pivoting, to gain access to a cargo storage space. Vehicles of this type are commonly used in the trades to transport products, parts therefor, and tools. The van construction is desirable from the standpoint that it affords a substantial volume of storage space, yet is maneuverable much like a passenger vehicle, and can be relatively economically operated. Front and side doors permit convenient access to different regions of the storage space, thereby allowing substantially the entire cargo space to be practically utilized.

The convenience of multiple access doors also makes this type of vehicle vulnerable to theft. Company identification prominently displayed on the exterior of the vehicle provides a general indication of the potential contents of the cargo space to observers. Consequently, those purveying and servicing expensive equipment must often take extra precautions to deter thievery.

Rear access doors are commonly mounted in pairs and pivoted at their sides to open away from each other. This may expose a substantial unobstructed area for introduction of articles into, and removal of articles from, the storage space.

In one common construction, one of the doors in the pair is designed to be locked directly to the vehicle frame. A lock actuator is located on the inside of this door and can be accessed from within the storage space or from externally thereof with the other door open. The other door is in turn latched and locked relative to the door that is locked to the frame. The latching mechanism between the doors can be placed selectively in latched and latched and locked states. Typically, this lock feature is operational through a key externally of the vehicle.

Regardless of the quality of the latching assembly that is incorporated into the vehicle as original equipment, this type of structure is prone to being defeated by thieves. This has prompted the incorporation of a redundant locking system that is commonly seen on van doors on a large percentage of commercial vehicles.

In one exemplary form, a pair of brackets is provided and mounted, one each to the doors in the cooperating pair. With a decades-old design, these brackets are mounted facially to the external surfaces of the doors, as by bolts. The brackets have offset, apertured tabs/flanges that situate adjacent to each other with the doors in the closed state therefor. A lock component can then be directed through the aligned apertures to prevent opening of the doors.

One of the most common locks systems is what is known in the industry as a "puck" lock. A puck-shaped casing has a receptacle for the aligned bracket tabs/flanges. With the tabs/flanges within the receptacle, a bolt is repositioned to be directed through the aligned tab/flange apertures. The bolt may be repositioned through a push button assembly or key operated. In the former case, a key operated system can be incorporated to lock the bolt.

This type of lock system has been well accepted by the industry and has been quite effective in terms of deterring theft. However this system, like most, has some limitations, including some that compromise its effectiveness.

A would-be thief can attempt to defeat the above system by twisting the puck-shaped casing around its central axis. For example, an annular circumferential surface thereon lends itself to the placement of a conventional pipe wrench. By forcibly turning the thickened mass of the casing, one or more of the interacting components may be caused to fail. The failure may be the result of the severance of the bracket tabs/flanges, separation of the brackets from the vehicles doors, and/or failure of one or more components on the puck lock itself.

In spite of the limitations that the conventional puck lock has had for decades, the industry has contended therewith since no viable commercial solutions have been devised to date. Theft, however, continues to be a very significant problem with vans and a number of other types of vehicles that use this basic lock system configuration. The industry continues to seek system designs and modifications that make vehicles more secure against theft.

Another problem that has been contended with in the past is the detrimental exposure of the external lock system components to rain, snow, dirt, chemicals, etc. Particularly moisture exposure is a concern, since it may migrate, as through key slots, to cause rust and corrosion that may impair operation of internal components and potentially make the entire system inoperable.

Regular exposure to moisture, chemicals, and other airborne contaminants may also over time cause visible parts of the lock systems to be compromised in appearance. The exposed metal components are typically plated with a metal such as chrome that gives them an attractive appearance and also protects underlying metal. However, constant external exposure may cause peeling, corrosion, or discoloration of the lock system components that detracts from the overall appearance of the associated vehicle. This is particularly a problem with conventional systems in which the "puck" is located prominently near eye level for individuals standing near the vehicle or occupying other vehicles in the vicinity thereof.

To address this problem, it is known to design a separate enclosure that will cover all of the external components of the lock system. One such design utilizes a generally cup-shaped housing with an outturned flange having one or more magnetic components that will attract to the external vehicle surface to maintain the housing in place. The housing is made with an internal chamber that is substantially larger than the exposed components so that it can be easily pressed into place without interference from the lock components. While this design provides a reasonably effective shield for the exposed components, it has a number of drawbacks.

First of all, a tether is required in combination with the housing to avoid separation, and potential loss, of the housing. This requires that the tether can be fixed to the vehicle. Aside from the inconvenience, any place a component is required to be fixed to a vehicle represents a location at which the aesthetics of the vehicle may be compromised and the vehicle may be prone to rusting.

Further, the tether itself may represent a less than attractive addition to the vehicle.

Further, the magnetic holding of the housing requires a direct contact between a part of the housing and the finished external surface of the vehicle. Regardless of the tenacity of the attraction of the magnetic component(s) to the vehicle surface, there is the potential that the surface will be scratched or scuffed.

If the holding force is relatively weak, the housing is prone to either falling off or shifting during vehicle operation. The latter may cause a progressive wearing of the vehicle surface finish.

A stronger holding force may cause even more surface finish damage as the housing shifts during vehicle operation or is bumped or otherwise caused to be shifted while operatively positioned.

The potential for damage to the vehicle is increased with the housing dangling from a tether so that it might swing repeatedly against the vehicle to impact and potentially mark the vehicle surface.

Still further, regardless of how much focus is placed on designing the housing for convenient placement and separation, the need to handle the housing represents an inconvenience.

In the interest of convenience, as noted above, the housings are normally made to provide a chamber that is substantially larger than the exposed lock system components. This allows the user to conveniently place the housing over the lock system components without requiring any predetermined and precise alignment thereof. The result of this is that the housing becomes a relatively large addition to a vehicle.

Many businesses use their commercial vehicles to advertise their products and services. These vehicles are commonly adorned with advertising and identification materials. Consequently, the vehicles inherently project an image of the company. Thus, most owners and operators attempt to maintain their vehicles in a state that is as aesthetically appealing as possible. Thus, the use of an unsightly housing that may be functionally adequate may compete with this objective.

The industry continues to seek out lock systems for vehicles that are affordable, secure, resistant to deterioration over time, and do not detract significantly from the appearance of the vehicles upon which they are placed.

SUMMARY OF THE INVENTION

In one form, the invention is directed to the combination of: a) an apparatus having a frame bounding an internal space and a first repositionable door that is movable between closed and open positions relative to the frame; b) cooperating components on the first door and at least one of: i) the frame; and ii) a second door that are alignable in a first relative position with the first door closed; c) a lock assembly that cooperates with the components with the first door in the closed position and the cooperating components in the first relative position and has a locked state wherein the lock assembly prevents the first door from being moved from its closed position into its open position; and d) a shielding assembly that conforms to at least a part of the exposed outer surface, overlies at least a part of the exposed outer surface, and is frictionally held against the lock assembly to be maintained in an operative state.

In one form, the shielding assembly has a body with a reconfigurable shape that is elastically deformed as the shielding assembly is placed in the operative state.

In one form, the shielding assembly has a body with a reconfigurable shape.

In one form, the body is made from at least one of a plastic and rubber material.

In one form, the exposed outer surface is made up of a first cylindrical surface portion with a central axis and a second surface portion that is generally flat and resides in a plane that is transverse to the central axis of the first cylindrical surface portion. The shielding assembly has a body with a cup-shaped internal surface that nominally conforms to each of the first cylindrical surface portion and second surface portion.

In one form, the internal surface of the body frictionally engages the first cylindrical surface portion to maintain the shielding assembly in the operative state.

In one form, the locking assembly includes a casing that defines the first cylindrical surface portion and the second surface portion.

In one form, the lock assembly includes a casing with an external surface and a first assembly that extends over at least a portion of the external surface of the casing to block access to the casing in a manner that would allow a repositioning force to be applied to the external surface of the casing to thereby cause the cooperating components and/or the lock assembly and/or the apparatus to be reconfigured with the first door closed and the lock assembly in the locked state, so that unauthorized access might be gained to the internal space by thereafter moving the first door from its closed position into its open position. The first assembly defines at least a part of the exposed outer surface that the shielding assembly overlies.

In one form, the shielding assembly has a body that is frictionally held against the part of the exposed outer surface that the shielding assembly overlies to maintain the shielding assembly in the operative state.

In one form, the first assembly has at least one cover component that is guided for movement in a predetermined path relative to the casing and the cover component defines the part of the exposed outer surface that the shielding assembly overlies and to which the body of the shielding assembly is frictionally held.

In one form, the at least one cover component includes a housing that is guided for movement in the predetermined path relative to the casing around an axis. The lock assembly consists of a key-actuated operator that is operable to change the lock assembly between the locked state and an unlocked state. The housing has a first discrete opening to permit access by a key to the key-actuated operator and the body on the shielding assembly has a second discrete opening through which the first discrete opening is exposed.

In one form, there is structure cooperating between the housing and body to consistently maintain the body in an operative orientation relative to the housing wherein the first discrete opening is exposed through the second discrete opening.

In one form, there is indicia on the body that is viewable to identify angular orientation of the housing around the axis with the body in the operative orientation relative to the housing.

In one form, there is structure cooperating between the housing and at least one of the apparatus, the cooperating components and a part of the lock assembly that releasably maintains the housing in a predetermined angular orientation around the axis.

In one form, with the housing in the predetermined angular orientation, the first and second discrete openings open in a downward direction.

In one form, the apparatus is a wheeled vehicle.

In one form, the wheeled vehicle has an external surface with a first color and the body has a color selected to be coordinated with the first color.

In one form, the cup-shaped internal surface closely embraces the first cylindrical surface portion to maintain the shielding assembly in the operative state.

In one form, the cup-shaped internal surface abuts to the second surface portion.

In one form, the exposed outer surface has an area and the shielding assembly overlies substantially all of the area of the exposed outer surface.

DETAILED DESCRIPTION OF THE PREFERRED EMBODIMENT

Figure 1:
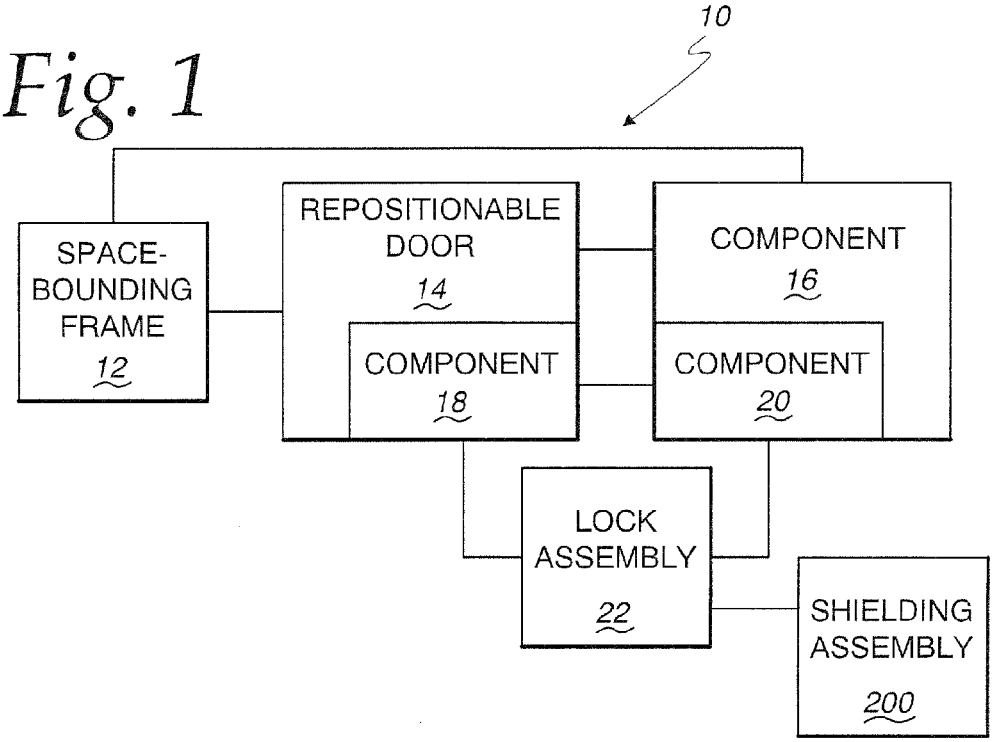
FIG. 1 is a schematic representation of an environment for a lock assembly with a shielding assembly according to the invention, including at least one repositionable door associated with a space-bounding frame.

In FIG. 1, a generic form of the invention is shown and consists of an apparatus 10, with a frame 12 that bounds an internal space, whether stationary in nature, such as a building, or movable, such as a vehicle. A repositionable door 14 is mounted on the frame 12 for movement between closed and open positions, with the latter allowing access to the internal space. The door 14 may be movable by translation, pivoting movement, etc. The door 14 cooperates with another component 16, that may be a part of the frame 12 or a separate element, such as another door, in a manner to allow the door 14 to be maintained in its closed position. Optional latch components (not shown) cooperate between the door 14 and component 16.

To facilitate locking of the door 14, components 18, 20 are provided, one each on the door 14 and component 16, respectively. With the door 14 in the closed position, the components 18, 20 align in a first relative position to allow a lock assembly 22 to be operatively engaged with the components 18, 20 and placed in a locked state. With the lock assembly 22 in the locked state, the door 14 is prevented from being moved from the closed position into the open position therefor.

It should be understood that the generic showing of the system is intended to encompass a lock assembly configuration wherein the components 18, 20 are held together in any manner. One such manner involves the direction of a component through registered apertures on the components 18, 20. However, while this is the most common design contemplated, as noted above, the components 18, 20 could have any other configuration whereby they cooperate with each other and a lock assembly 22, with the door 14 in the closed position, to prevent the door 14 from being moved from its closed position into its open position.

In FIGS. 2-7, one specific form of the lock assembly 22 is shown on an apparatus 10 in the form of a vehicle/van 10. In this embodiment, the vehicle 10 has a door 14 that is hinged to the frame 12 to allow it to pivot between open and closed positions. The component 16 is in the form of a like door that pivots oppositely between open and closed positions relative to the frame 12. Latch components 24, 26 are provided, one each on the doors 14, 16, respectively, and cooperate to releasably maintain the doors 14, 16 in the closed position shown in FIG. 2.

The door 14 is shown to have a locking component 28 that cooperates with a locking component 30 on the frame 12 to lock the door 14 in its closed position. The door 16 may have a like locking component (not shown) to cooperate with the frame 12 in the same manner. Typically, a locking feature will be incorporated into the latching mechanism so that the latch components 24, 26 can be selectively locked in a latched state.

The aforementioned lock components 18, 20 each consists of a generally flat plate attached respectively to the doors 14, 16. The plate 18 has an aperture 32 with the plate 20 having a like aperture 34. The apertures 32, 34 are formed in tabs 36, 38 on the plates 18, 20, respectively.

Figure 2:
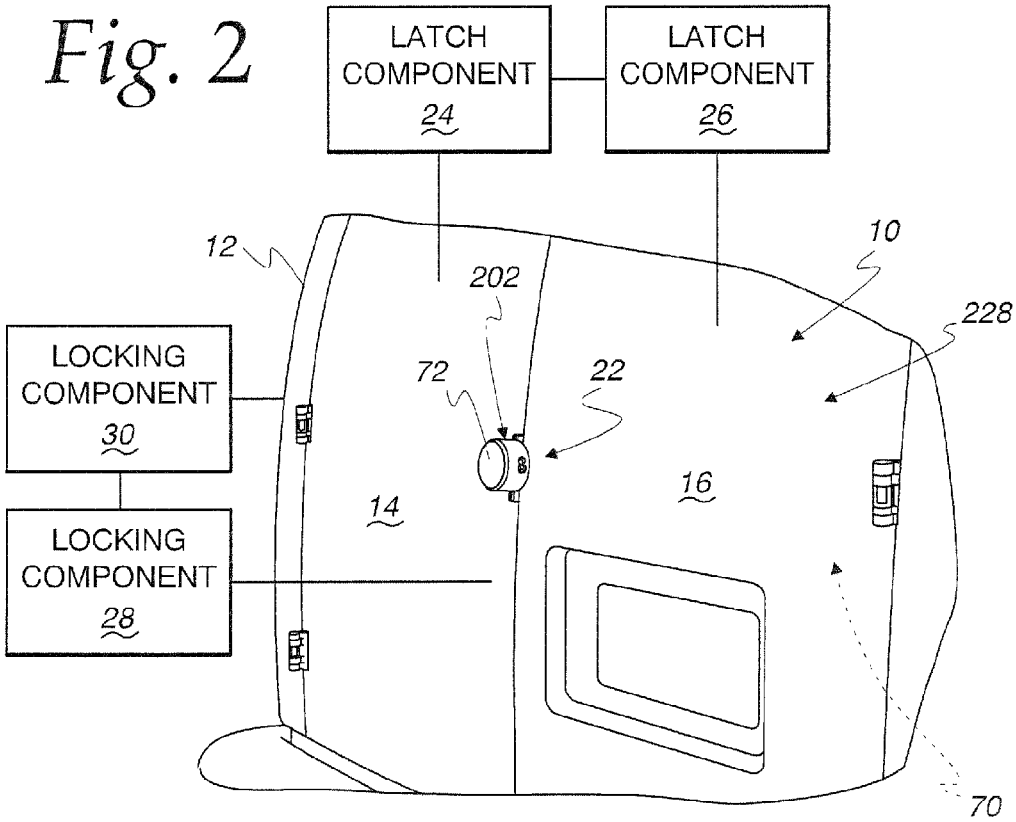
FIG. 2 is a fragmentary, perspective view of one specific, exemplary environment for the present invention, in the form of a vehicle with hinged doors having associated components that are engaged by the inventive lock assembly.
Figure 3:
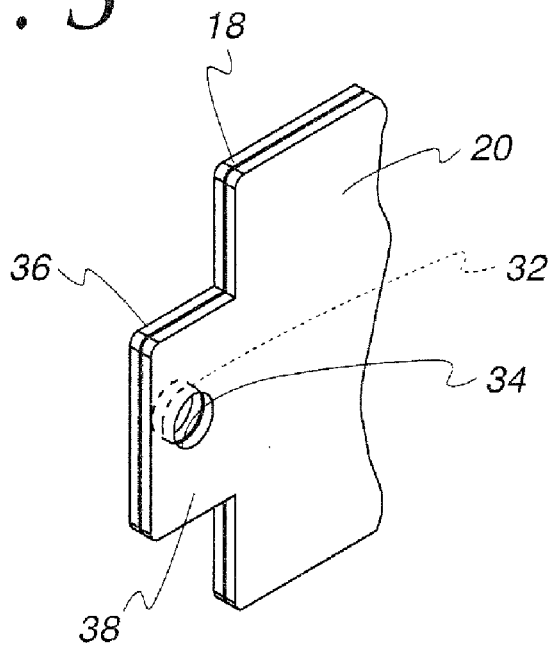
FIG. 3 is an enlarged, fragmentary, perspective view of the components on the vehicle with which the lock assembly is engaged with the doors in a closed position.

With the doors 14, 16 each in its closed position, as shown in FIG. 2, the tabs 36, 38, which have a generally matched shape, are relatively positioned in close proximity to each other with the apertures 32, 34 aligned/registered.

The lock assembly includes a casing 40 that cooperates with the lock components 18, 20. The casing 40 has a disk/puck-shaped body 42 with an outer surface 44 consisting of an annular, peripheral portion 46 and a generally flat, front portion 48. The body 42 has a rear wall 50 through which a rearwardly opening receptacle 52 is defined. The receptacle 52 is configured to receive both tabs 36, 38 with the doors 14, 16 in their closed positions. The receptacle 52 has sufficient depth that the aligned apertures 32, 34 reside fully within the receptacle 52.

Figure 4:
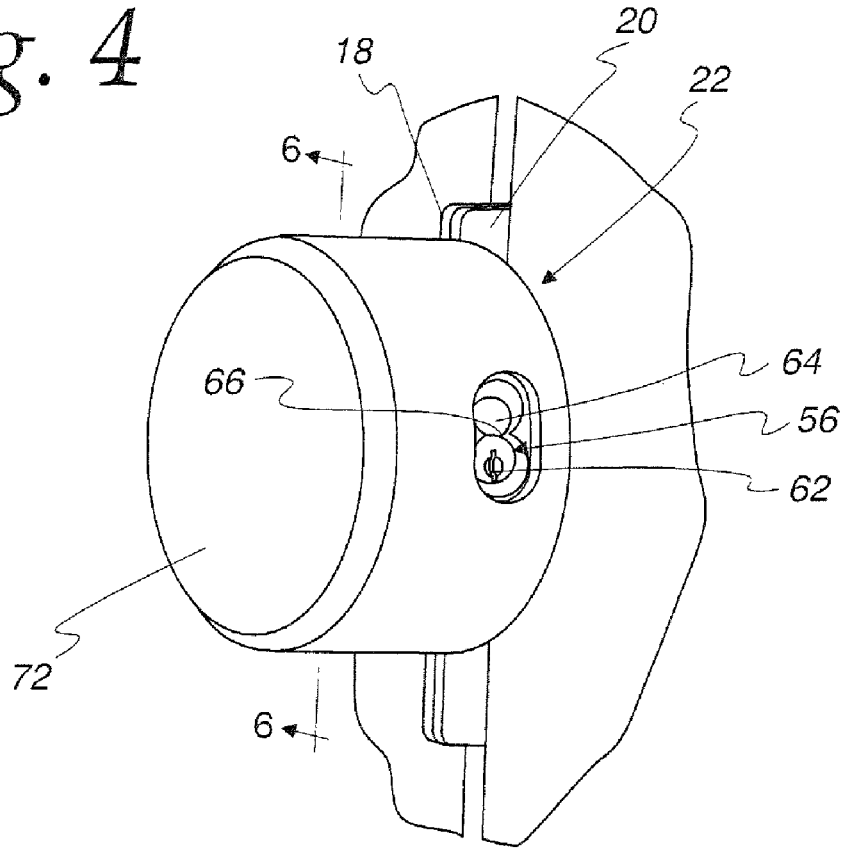
FIG. 4 is a view as in FIG. 3 with the lock assembly of FIG. 2 in place.
Figure 5:
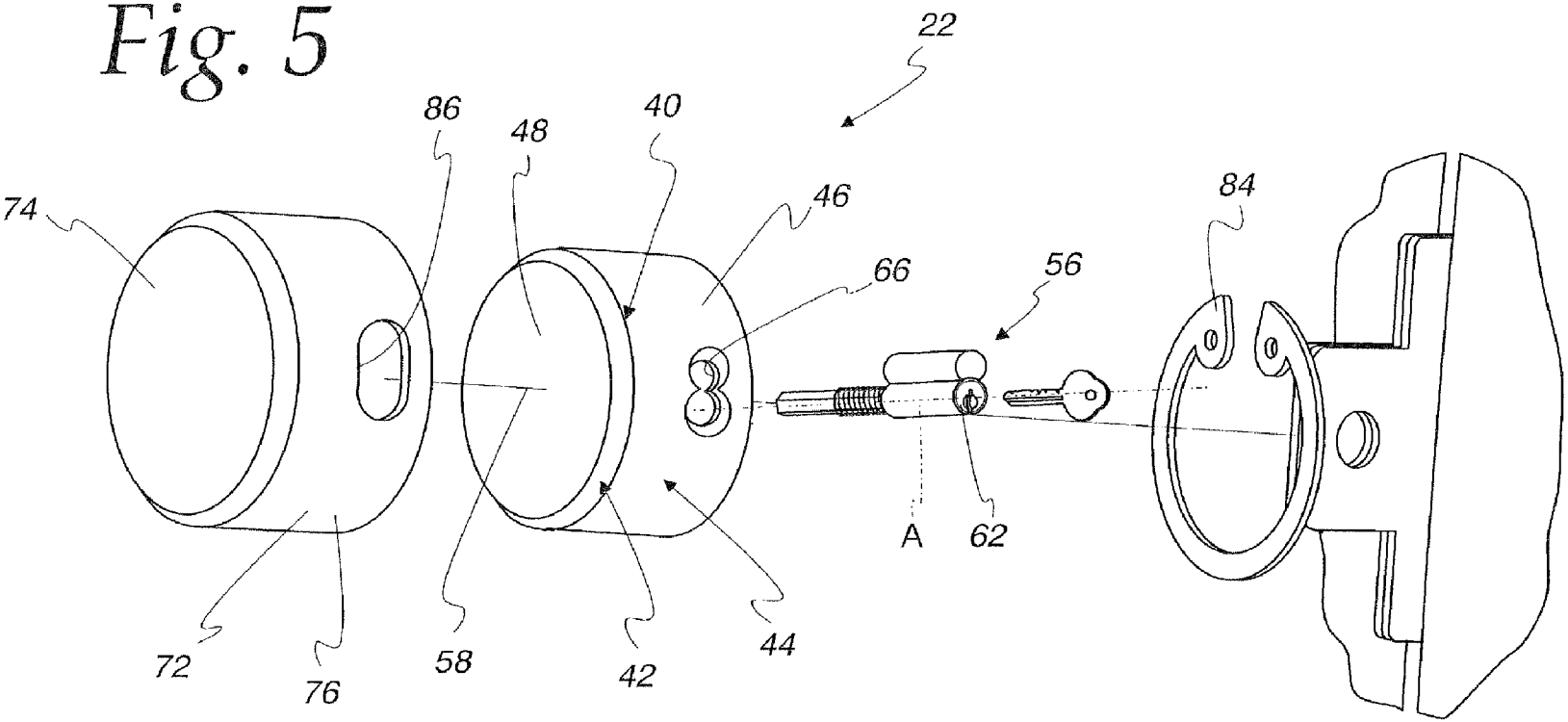
FIG. 5 is an enlarged, exploded, perspective view of the components shown in FIG. 4.

The lock assembly 22 further consists of a bolt 54 that is selectively extendible into, or further into, the receptacle 52 and through the aligned apertures 32, 34 residing therewithin. More specifically, the bolt 54 is part of an operator 56 that is movable radially relative to a central axis 58 of the body 42 between a retracted position, as shown in FIG. 5 and in dotted lines in FIG. 7, and an extended position, as shown in FIG. 4 and in solid lines in FIG. 7. In the former position, the bolt 54 shifts out of the receptacle 52 to allow the tabs 36, 38 to be directed thereinto and to be withdrawn therefrom. The operator 56 is actuated through a key 60 that is directed into a conventional cylinder 62.

In this embodiment, the cylinder 62 is incorporated into a body 64 that has an overall shape of a figure "8" as viewed along the operating axis A. The body 64 is keyed in a complementarily-shaped bore 66 through the body 42, to allow guided translation of the body 64 in a line indicated by the double-headed arrow 68 (FIG. 7), while preventing turning of the body 64 relative to the body 42 around the axis A.

The above-described basic components are, for the most part, conventional and are installed as follows. With the doors 14, 16 in their closed positions, the body 42 can be oriented to align the tabs 36, 38 with the receptacle 52. The body 64 on the operator 56 is retracted to shift the bolt 54 so that it does not obstruct passage of the tabs 36, 38 into the receptacle 52. Once the tabs 36, 38 are fully seated in the receptacle 52, the body 64 can be shifted to direct the bolt 54 through the aligned apertures 32, 34 in the receptacle 52. By then turning the operating key 60 and cylinder 62, the body 64 is locked in place with the bolt 54 extended through the apertures 32, 34, as a result of which neither of the doors 14, 16 can be opened. The operating key 60 can then be removed.

As noted in the Background portion herein, with the basic components described above, the outer surface 44 of the body 42 is situated so that it can be engaged as by a pipe wrench or other tool, and turned/torqued to defeat the system. This may be effected by breaking off the tabs 36, 38, causing part of the vehicle 10 to break away and/or by causing a portion of the body 42 to be reconfigured so that the doors 14, 16 might thereafter be moved from their closed positions into their open positions to gain unauthorized access to an internal space 70 bounded cooperatively by the vehicle frame 12 and doors 14, 16.

According to the invention, the lock assembly 22 additionally incorporates at least one cover component, in this case in the form of a housing 72, that precludes the aforementioned tampering. The housing 72 is generally cup-shaped with a front wall 74 and a peripheral wall 76.

The housing 72 has an inside surface 78 bounding a receptacle 80 for the body 42. The inside surface 78 has a shape that at least nominally conforms to the shape of the outer surface 44 of the body 42, as seen most clearly in FIG. 6. With this arrangement, the outer surface 44 of the body 42 and inside surface 78 of the housing 72 interact to guide movement of the housing 72 in a predetermined path relative to the casing 40 around the central axis 58 of the body 42.

Figure 6:
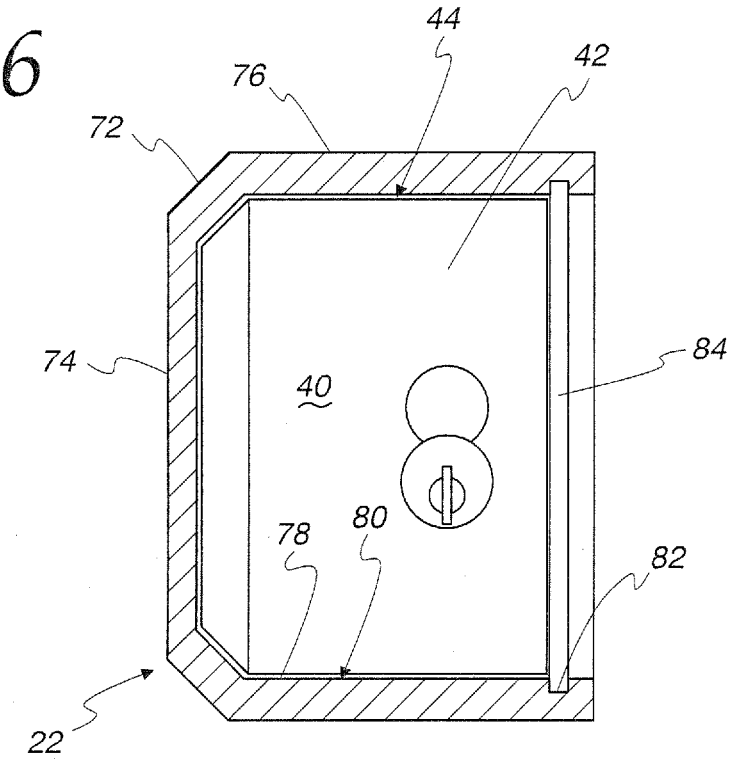
FIG. 6 is a partial cross-sectional view of the lock assembly taken along line 6-6 of FIG. 4.

The peripheral wall 76 on the housing 72 has an annular groove/receiver 82 at a rear region thereon. The groove/receiver 82 is configured so that a conventional C-clip/holding clip 84 can be press fit into the groove/receiver 82. With the C-clip 84 in place, as shown in FIG. 6, the casing 40 is captive axially between the front wall 74 of the housing 72 and the C-clip 84. A certain amount of clearance is provided both axially and radially between the cooperating components 40, 72, 84 but is preferably limited so that there is minimal play between these components. At the same time, clearance must be adequate so that the housing 72 can rotate freely around the axis 58 relative to the casing 40.

With this arrangement, the casing 40 is conventionally mounted and performs in its normal manner. At the same time, access to the annular surface portion 46 is obstructed by the housing wall 76. Consequently, if a would-be thief attempts to defeat the system by torquing the housing 72, as by placing a pipe wrench around the peripheral wall 76 on the housing 72 to effect turning of the casing 40, the resulting movement of the housing 72 will cause it to turn freely relative to the casing 40 without in any way moving, or compromising the function of, the casing 40.

The front wall 74 of the housing 72 also blocks access to the casing 40. However, this feature is generally not critical. In fact, the front wall 74 may be open over a portion of its areal extent so long as there is an adequate front structure that produces the captive arrangement with the C-clip 84, as described above.

The housing peripheral wall 76 has a discrete opening 86 that can be selectively registered with the operator 56 by turning the housing 72 around the axis 58. This allows the insertion of the operating key 60 and the retraction of the body 64, using the key 60, through the peripheral wall opening 86.

With the described construction, the lock assembly 22 can be offered to users as part of an assembly including the casing 40. Alternatively, the housing 72 can be sold to users for aftermarket assembly.

While the use of the conventional C-clip 84 allows on-site assembly and potentially separation of the housing 72, the invention also contemplates that the housing 72 might be sold as an inseparable part in conjunction with the casing 40.

Figure 8:
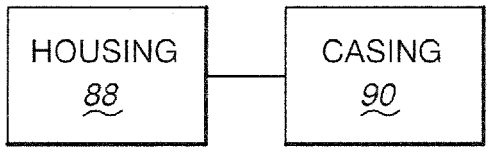
FIG. 8 is a schematic representation of the inventive lock assembly.
Figure 9:
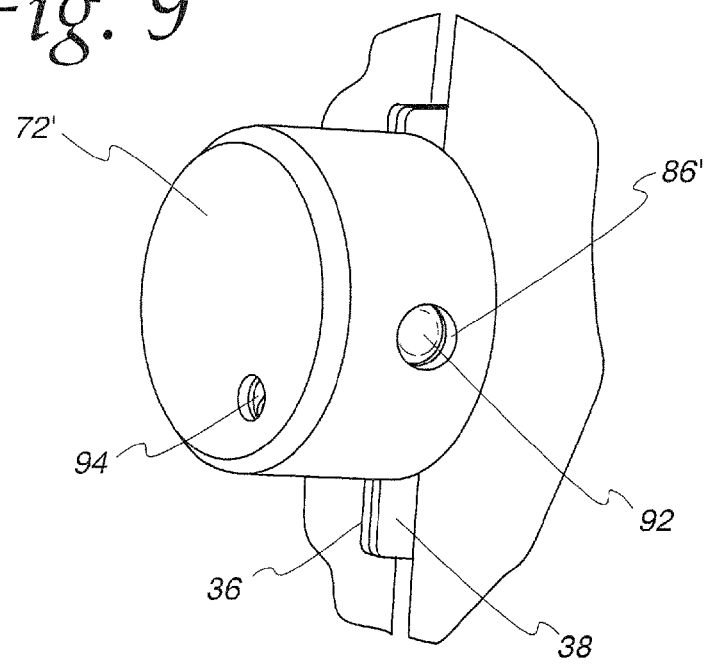
FIG. 9 is a view as in FIG. 4 of a modified form of the inventive lock assembly.

Many other variations are contemplated for the housing, as shown generically at 88 in FIG. 8, and cooperating casing 90, as also shown generically in that same Figure. As just one example contemplated within the generic showing in FIG. 8, the housing 88 need not extend continuously around the peripheral wall of the casing 90. Modified structures that would perform the function of preventing engagement, as by a tool, are contemplated. Additionally, while the housing is shown in association with a conventional casing, each of these components might be customized based upon particular demands of the users and the environment.

The specific embodiments disclosed herein are intended to be exemplary in nature only. The generic showing in FIG. 8 is intended to encompass these and numerous other variations within the basic concepts of the invention as disclosed herein.

As a further variation, a modified housing 72' is shown in conjunction with another conventional casing 40' in FIGS. 9-13. The casing 40' has the same general overall configuration, including a body 42', with a rear wall 50' through which a rearwardly opening receptacle 52' is formed to accept the tabs 36, 38.

In this embodiment, the bolt 54' is spring-loaded normally to a retracted position. A rounded head 92 defines an actuating portion that can be pressed to move the bolt 54' radially inwardly relative to the axis 58' so that it extends through the apertures 32, 34 in the tabs 36, 38, respectively. Through a detent arrangement (not shown), the bolt 54' is maintained in the extended position.

A key actuated cylinder 94 is part of an operator through which the bolt 54' can be selectively locked in the extended position and released to be retracted under the force of a surrounding coil spring 96.

The housing 72' has one discrete opening 86' to accommodate the bolt 54' and head/actuator portion 92. The housing 72' has a separate discrete opening 98 in the front wall 74' to register with the key actuated operator 94.

As with the prior embodiment, the casing 40' has an outer surface 44' that is nominally matched to the inside surface 78' of the housing 72' so that the housing 72' can be turned guidingly relative to the casing 40' around the central axis 58'. The C-clip 84 maintains the component connection as in the prior embodiment. Alternatively, a permanent connection between the casing 40' and housing 72' can be established. The components otherwise function substantially as the corresponding components described above.

In FIGS. 14-19, different housing configurations for use in conjunction with the casing 40 are shown.

A housing 72" has a ring shape defined by an annular, peripheral wall 76" through which a discrete opening 86" is provided to perform the function of the discrete opening 86, described earlier.

A radially inwardly projecting, annular bead 110 is provided at the rear of the peripheral wall 76" to thereby define a forwardly facing annular shoulder 112 that blocks rearward movement of the casing 40.

The front region of the housing 72" has a groove/receiver 114 to receive a holding clip 116. The holding clip 116 has a conventional C-clip shape and performs as the aforementioned clip 84 and is expandable into the groove/receiver 114 to define a blocking shoulder that is abuttable to the front of the casing 40, whereby the casing 40 remains captive between the shoulder 112 and holding clip 116.

In one preferred form, the holding clip 116 abuts to a chamfered region 118 at the front of the casing 40 to thereby block forward shifting of the casing 40 relative to the housing 72".

Figure 16:
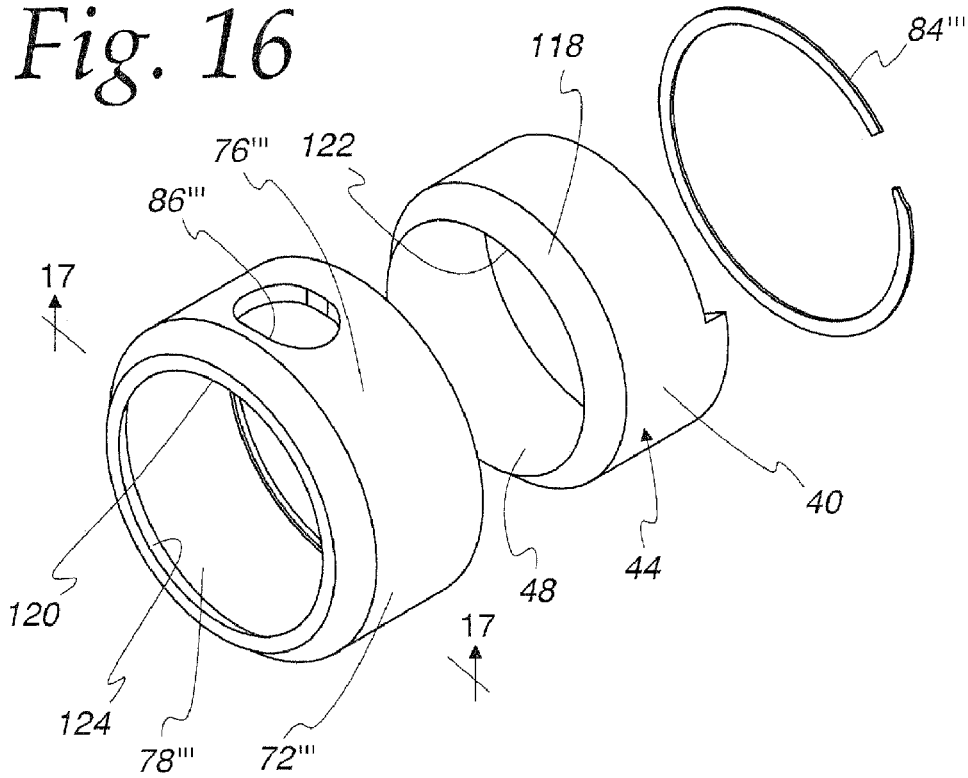
FIG. 16 is an exploded perspective view of a further modified form of lock assembly, according to the present invention.
Figure 17:
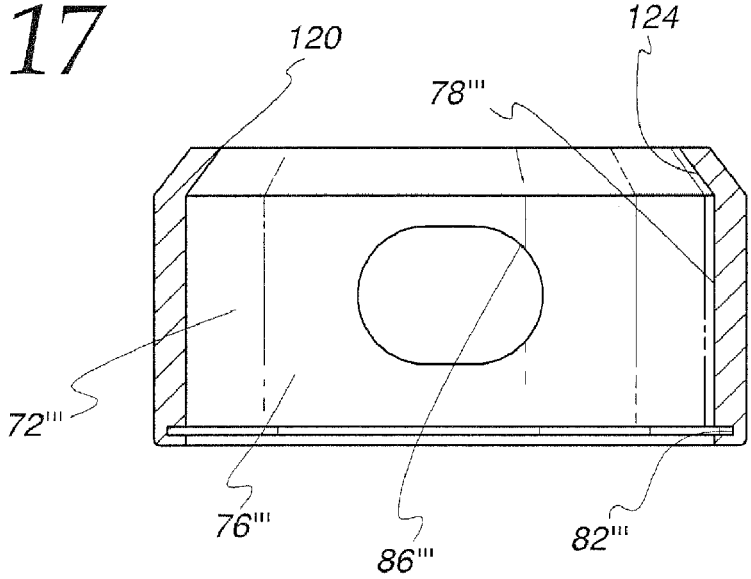
FIG. 17 is a cross-sectional view of a housing on the lock assembly taken along line 17-17 of FIG. 16.

In FIGS. 16 and 17, a housing 72''' is shown with a configuration similar to the housing 72, with the primary difference being that there is an opening 120 at the front of the housing 72'''. The inside surface 78''' of the housing 72''' conforms to the outer surface 44 of the casing 40 substantially up to a transition location at 122 on the casing 40 where the chamfered region 118 blends into the flat, front surface portion 48 on the casing 40. An inside surface portion 124 on the housing 72''' cooperates with the chamfered region 118 to limit forward movement of the casing 40 relative to the housing 72'''.

A groove/receiver 82''' is provided at the rear of the housing 72''' to receive a retaining clip 84'''.

The housing 72''' has a discrete opening 86''' in a peripheral wall 76''' to perform the function of the aforementioned discrete opening 86 in the earlier described embodiment.

Figure 18:
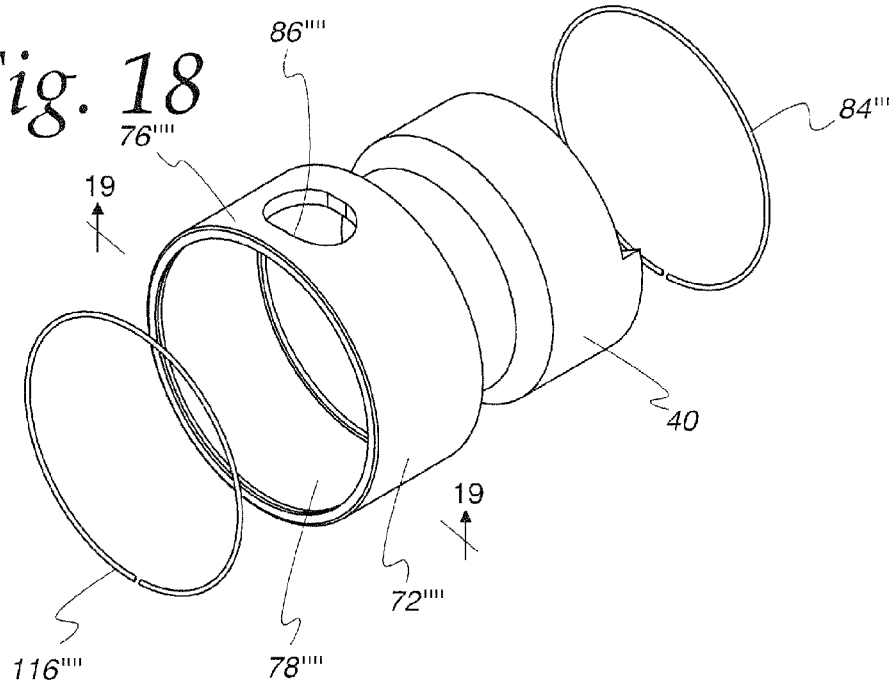
FIG. 18 is an exploded perspective view of a still further modified form of lock assembly, according to the present invention.
Figure 19:
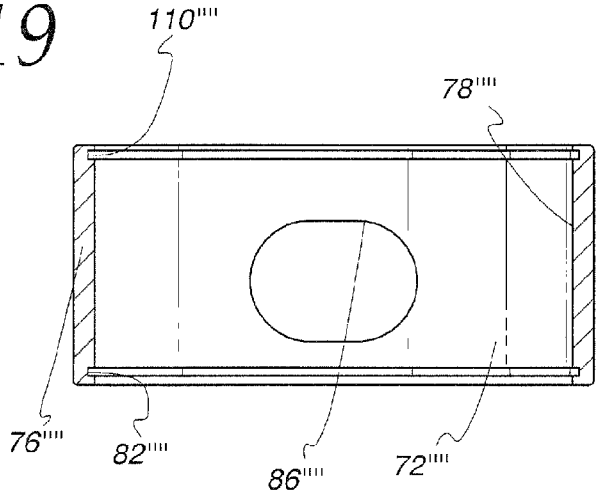
FIG. 19 is a cross-sectional view of a housing on the lock assembly taken along line 19-19 of FIG. 18.

In FIGS. 18 and 19 a housing 72'''' is shown with a peripheral wall 76'''' with an inside surface 78'''' having a constant through diameter. The housing 72'''' has front and rear grooves/receivers 110'''', 82'''', respectively, to receive retaining clips 116'''', 84'''', respectively. With the housing 72'''' shifted over the casing 40, and the retaining clips 84'''', 116'''' in place, fore-and-aft shifting of the casing 40 relative to the housing 72'''' is confined in opposite directions by the retaining clips 84'''', 116''''. The retaining rings 84'''', 116'''' engage the casing 40 preferably in the same manner as their counterparts 84, 116, described above.

The housing 72'''' has a discrete opening 86'''' in the peripheral wall 76'''' that performs the function of the discrete opening 86, described above.

In the embodiments shown in FIGS. 14-19, the housings 72", 72''', 72'''' generally have a configuration that requires less material, and that may lend itself to simpler and less expensive manufacture, as compared for example to the housing 72, described above. On the other hand, the housing 72, by reason of being closed at the front region thereof, does not expose any part of the lock assembly that may allow a thief to defeat the same.

Figure 20:
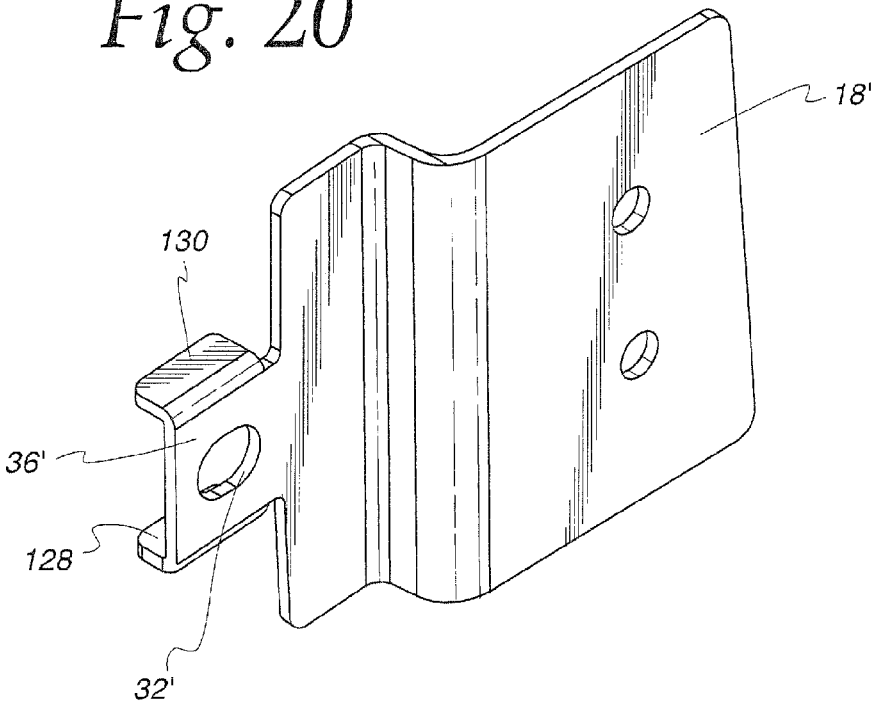
FIG. 20 is a perspective view of a modified form of component/plate with which the inventive lock assembly cooperates.
Figure 21:
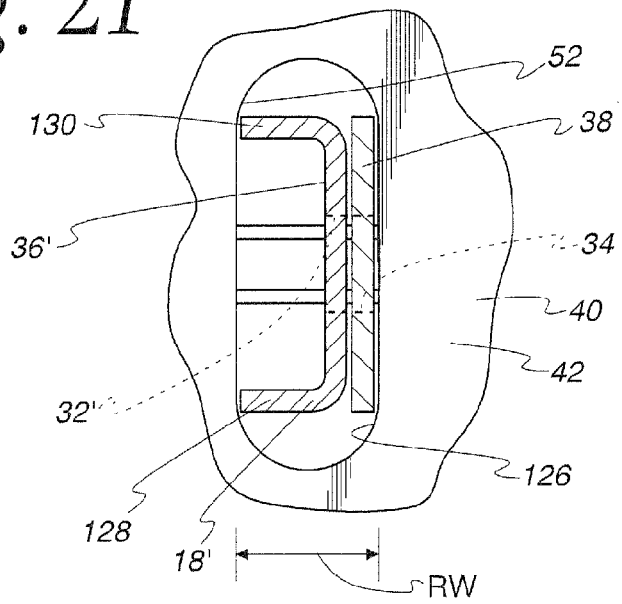
FIG. 21 is a fragmentary, rear elevation view of the lock assembly, as shown in FIG. 7, with a tab on the component/plate shown substituting for its counterpart in FIG. 7.

In FIGS. 20 and 21, a component/plate 18' is shown that is a variation of the component/plate 18, described hereinabove. The component/plate 18' is designed to take up some or all of the "play" that results with the aforementioned tabs 36, 38 in the receptacle 52 at the rear of the body 42 on the casing 40.

Figure 7:
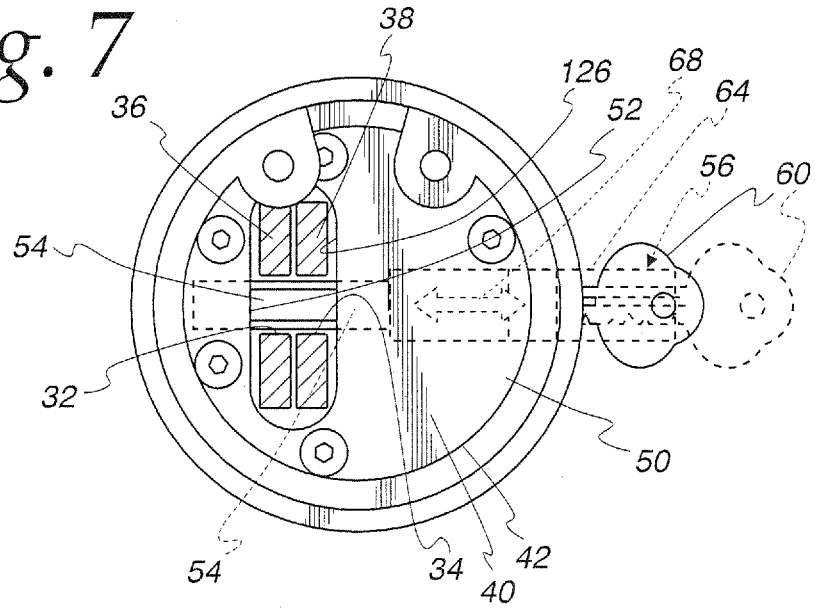
FIG. 7 is an enlarged, rear elevation view of the lock assembly.

In FIG. 7, the tabs 36, 38 are shown with a relatively thick construction to thereby fill the width of the receptacle 52 to an extent to avoid excessive play that allows the lock assembly 22 to shift back and forth in a generally horizontal line. More preferably, the components/plates 18, 20 and associated tabs 36, 38 are made from a relatively thin stock having a constant gauge over the entire extent thereof. As a result, a more significant gap may be present between the tabs 36, 38 and the wall surface 126 bounding the receptacle.

With the component/plate 18', the tab 36' is modified by providing at least one, and in this embodiment two, spacers 128, 130 that are bent orthogonally to a plane through the center of the tab 36'.

As can be seen most clearly in FIG. 21, the spacers 128, 130 fill the receptacle width RW so that the tab 36' functions in the same manner as a tab with a thicker material, without requiring the additional material thickness.

The tab 36' has an aperture 32' to align with the aperture 34 in the cooperating tab 38.

It should be understood that the tab 38 could likewise have one or more spacers corresponding to the spacers 128, 130, with dimensions of any and all tab(s) dictated by the gauge of the material and the dimensions of the receptacle 52.

The component/plate 18' also lends itself to construction from a single blank of flat sheet stock. The single piece can be bent into the FIG. 20 configuration economically using conventional tooling.

Another aspect of the invention is the provision of a shielding assembly, as shown at 200 in FIG. 1, that conforms to at least a part of the exposed outer surface 202 (FIG. 2) of the lock assembly 22, overlies at least part of the exposed outer surface 202, and is frictionally held against the lock assembly 22 to be maintained in an operative state wherein the shielding assembly 200 affords protection against direct exposure of the outer surface 202 to external contamination, such as moisture, dirt, chemicals, etc.

Figure 22:
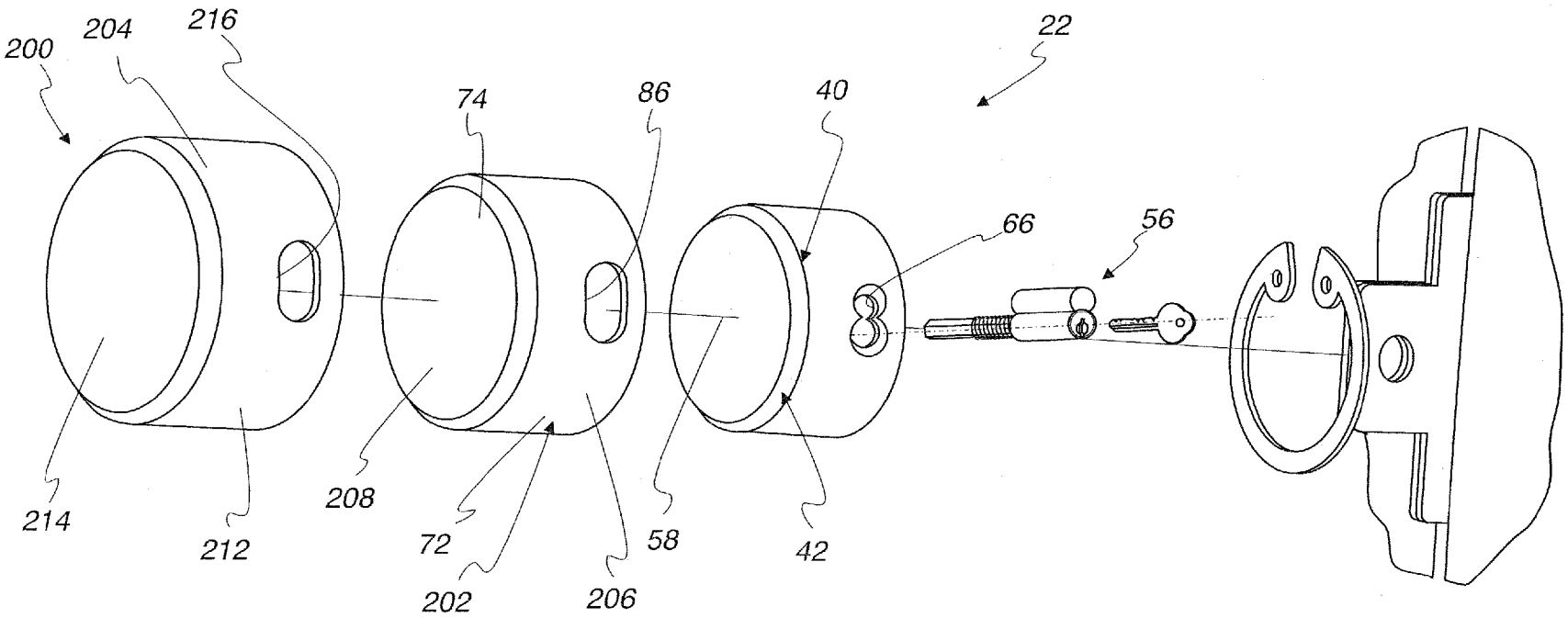
FIG. 22 is a view as in FIG. 5 including a shielding assembly, according to the present invention.
Figure 23:
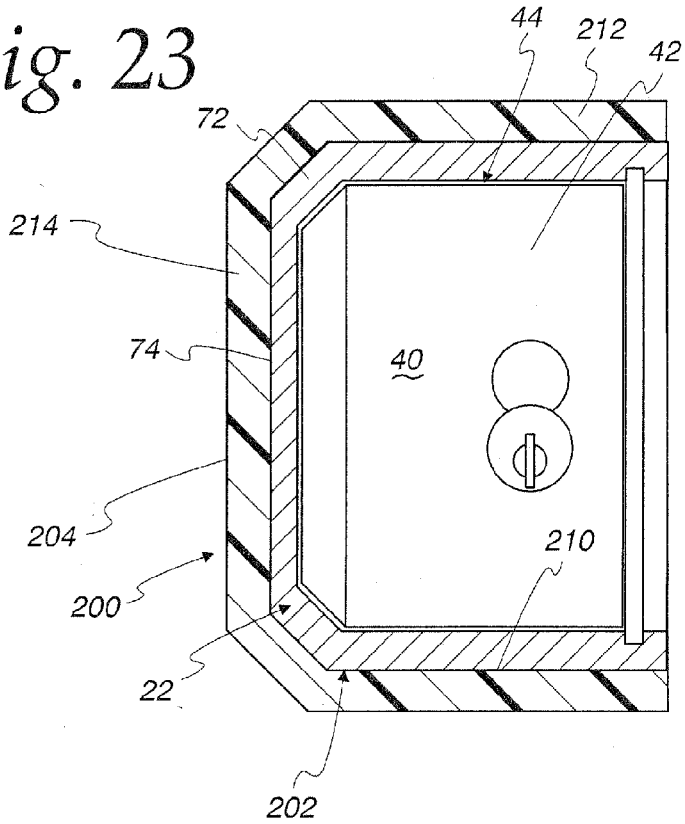
FIG. 23 is an enlarged, cross-sectional view of the components in FIG. 22 in an assembled state and with the shielding assembly in an operative state.

One specific form of shielding assembly 200 is shown in FIGS. 22 and 23. The shielding assembly 200 is shown in FIGS. 22 and 23 on the lock assembly 22, as seen in FIGS. 5 and 6. The shielding assembly 200 has a body 204 with a reconfigurable shape that is elastically deformable. The body 204 may be made from rubber, plastic, or other material that might be readily selected by one skilled in the art. The guidance for such design is that the body 204 is preferably configured to be squeezed against the housing/cover component 72 so that frictional forces between the body 204 and housing/cover component 72 maintain the shielding assembly 200 in the operative state as shown in FIG. 23. The body 204 may be slightly expanded to accept the housing/cover component 72 so that residual forces more aggressively maintain the connection between the shielding assembly 200 and housing/cover component 72.

Once in place, the shielding assembly 200 ideally will not only serve as a barrier against exposure of the portion of the exposed outer surface 202 that it overlies, but also have a degree of durability that will allow it to withstand the rigors of the jobs on sites at which vehicles incorporating the lock assembly 22 are utilized.

The exposed outer surface 202 is made up of a first cylindrical surface portion 206 that is centered on the axis 58, and a second surface portion 208 that is generally flat and resides in a plane that is transverse to the central axis 58 of the first cylindrical surface portion 206.

The body 204 has a cup-shaped internal surface 210 that nominally conforms to at least one, and preferably to each, of the first cylindrical surface portion 206 and second surface portion 208. In FIG. 23, the internal surface 210 is shown to substantially fully conform to the exposed outer surface 202 of the lock assembly 22, which surface 202 is defined substantially entirely by the cover component/housing 72. It is preferred that the internal surface 210 frictionally engage at least the first cylindrical surface portion 206 so that the closely embraced portion of the body 204 defining the surface portion 206 will move as one piece with the body 204 around the axis 58 with the shielding assembly 200 in its operative state.

The body 204 has a peripheral, annular wall 212 with a flat wall 214 at one axial end thereof to produce the cup shape. The peripheral wall 212 has a circumferentially elongated discrete opening 216 through which the discrete opening 86 on the housing/cover component 72 is exposed. In this embodiment, the openings 216, 86 have substantially the same shape and size so that they register to define a through opening.

Figure 28:
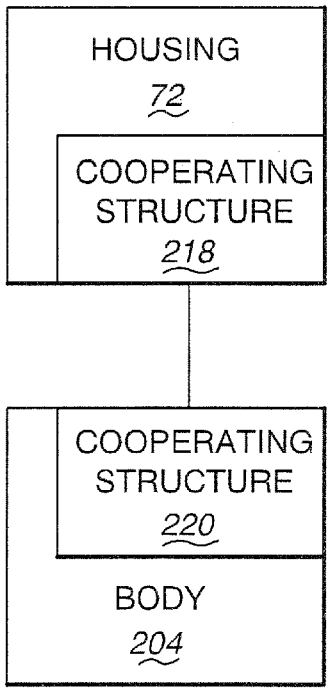
FIG. 28 is a schematic representation of structure cooperating between a body on the inventive shielding assembly and housing on the lock assembly that maintains the shielding assembly consistently in its operative state.

While the frictional forces acting between the housing 72 and body 204 may be relied upon to maintain the body 204 in an operative orientation relative to the housing 72, wherein the openings 216, 86 are maintained in registration, additional structure 218, 220, respectively on the housing 72 and body 204, may be provided, as shown in FIG. 28, to consistently maintain this operative orientation. The cooperating structure 218, 220 may be any type of structure known to those skilled in the art, such as rails, ribs, detent-type arrangements, etc.

Ideally, when access to the operator 56 is not required, the housing/cover component 72 is turned so that the opening 86 does not align with the bore 66 through the body 42 on the casing 40. More preferably, the cover component/housing 72, with the shielding assembly 200 in the operative state thereon, is turned so that the openings 86, 216 are at a downward/six-o'clock position so that water does not tend to travel directly therethrough.

Figure 30:
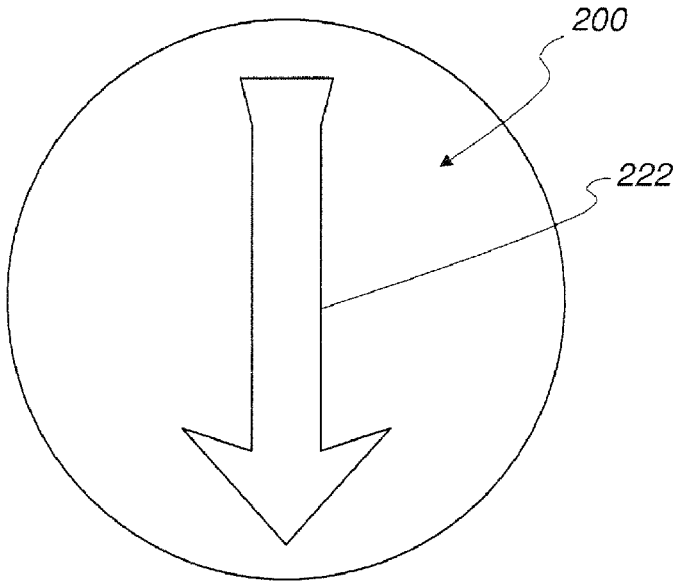
FIG. 30 is a front elevation view of a shielding assembly, according to the invention, and showing indicia that allows a user to identify an angular orientation of the shielding assembly.

To facilitate placement of the cover component/housing 72 in this preferred angular orientation, indicia 222, as shown in FIG. 30, may be provided to visually alert the user of the particular angular orientation of the cover component/housing 72. In this case, the indicia 22 is shown as an arrow that points downwardly with the openings 86, 216 at the six-o'clock position. Alternatively, business information, such as a logo, business name, etc., might be provided on the shielding assembly 200.

Figure 29:
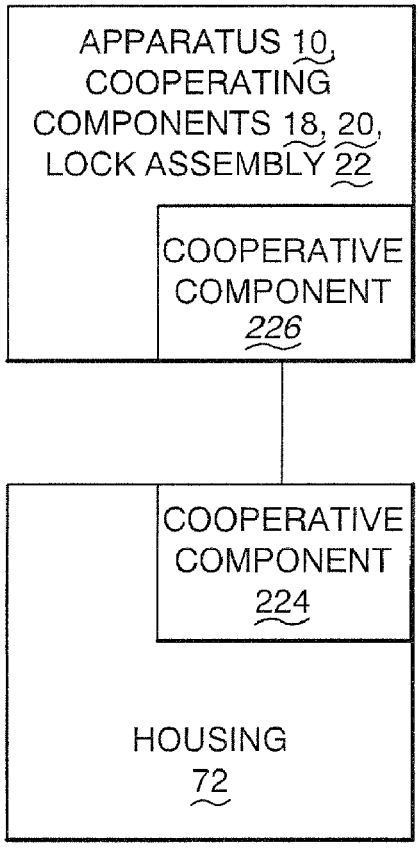
FIG. 29 is a schematic representation of cooperating components on a housing on the inventive lock assembly and other system components that allow the housing to be releasably maintained in a predetermined angular orientation.

As shown in FIG. 29, cooperating components 224, 226 may be provided respectively on the housing 72 and at least one of the apparatus 10, cooperating components 18, 20, and lock assembly 22, to consistently, releasably maintain the housing 72 in a predetermined angular orientation, as shown in FIG. 30, wherein the openings 86, 216 are at the six-o'clock position. Alternatively, the three-o'clock position may be identifiable to facilitate key insertion, as shown in FIG. 22. Again, the components 224, 226 may be devised by one skilled in this art and may be in the form of a detent arrangement or any other type of arrangement that will releasably maintain a desired angular orientation.

To potentially obscure the presence of the shielding assembly 200, or to coordinate its appearance with the apparatus, such as the vehicle 10, the body 204 may be made with a color that is coordinated with the color of the external surface 228 of the apparatus/vehicle 10.

As seen in FIG. 23, the shielding assembly 200 overlies substantially the entire exposed area of the lock assembly 22, in this case defined by the housing 72. This, however, is not a requirement.

Additionally, while full conformity of the internal surface 210 to the outer surface of the housing 72, including abutment to the front wall 74 of the housing 72 is shown, this likewise is not a requirement.

Still further, the exposed external shape of the body 204 may be arbitrary, rather than conforming to the shape of the housing 72.

As another variation, the shielding assembly 200 might be permanently applied, as by using an adhesive.

Figure 10:
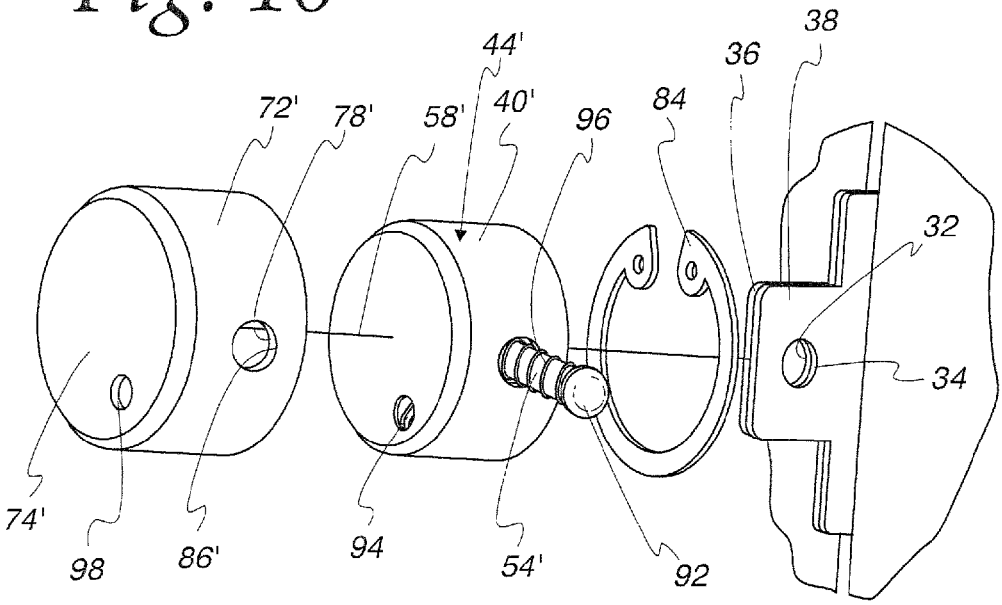
FIG. 10 is an exploded perspective view of the components in FIG. 9.
Figure 11:
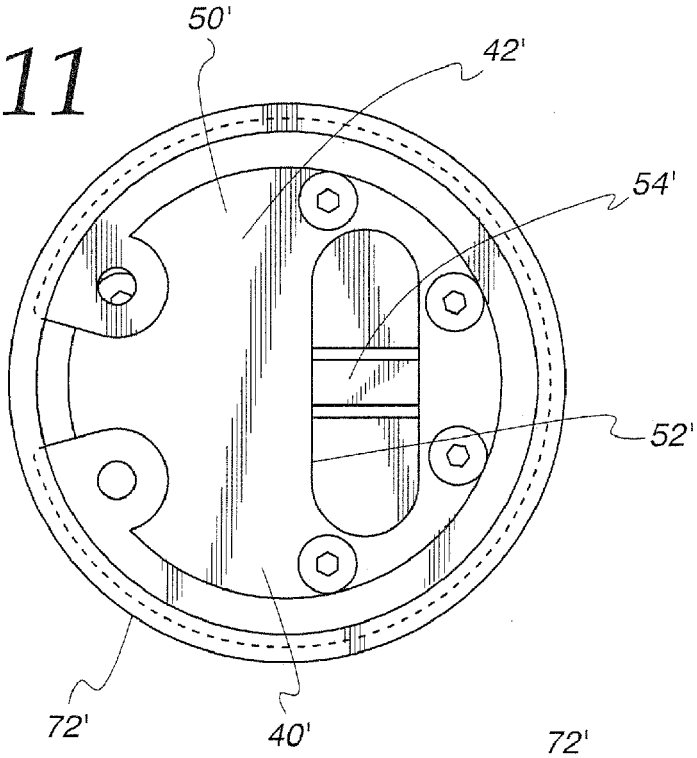
FIG. 11 is an enlarged, rear elevation view of the lock assembly in FIGS. 9 and 10.
Figure 12:
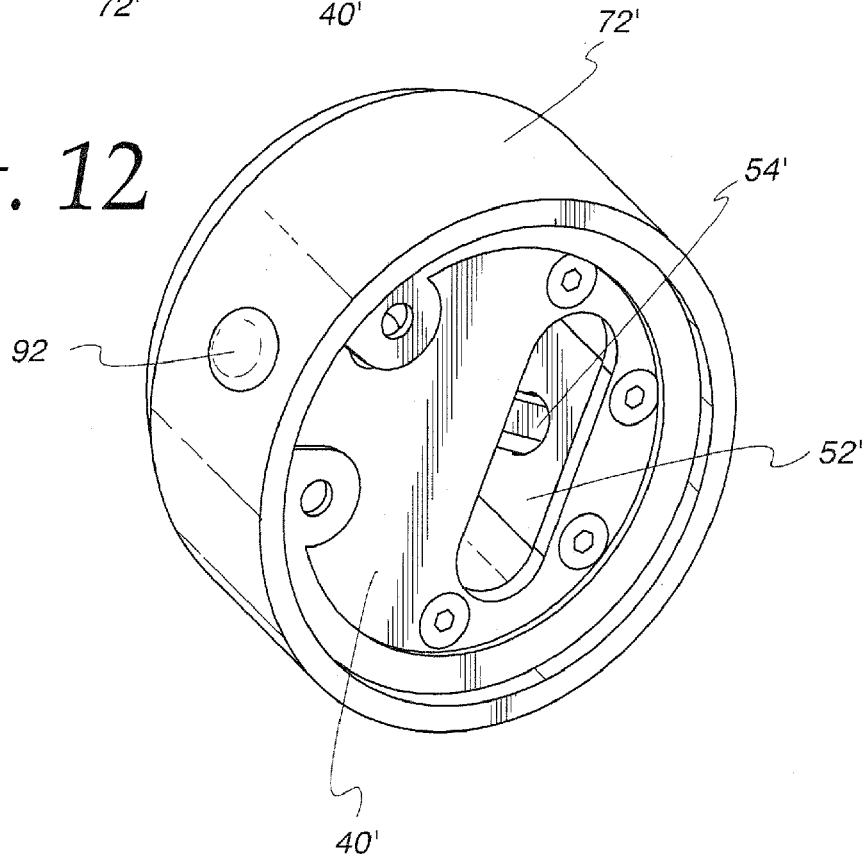
FIG. 12 is an enlarged, rear perspective view of the lock assembly in FIGS. 9-11.
Figure 13:
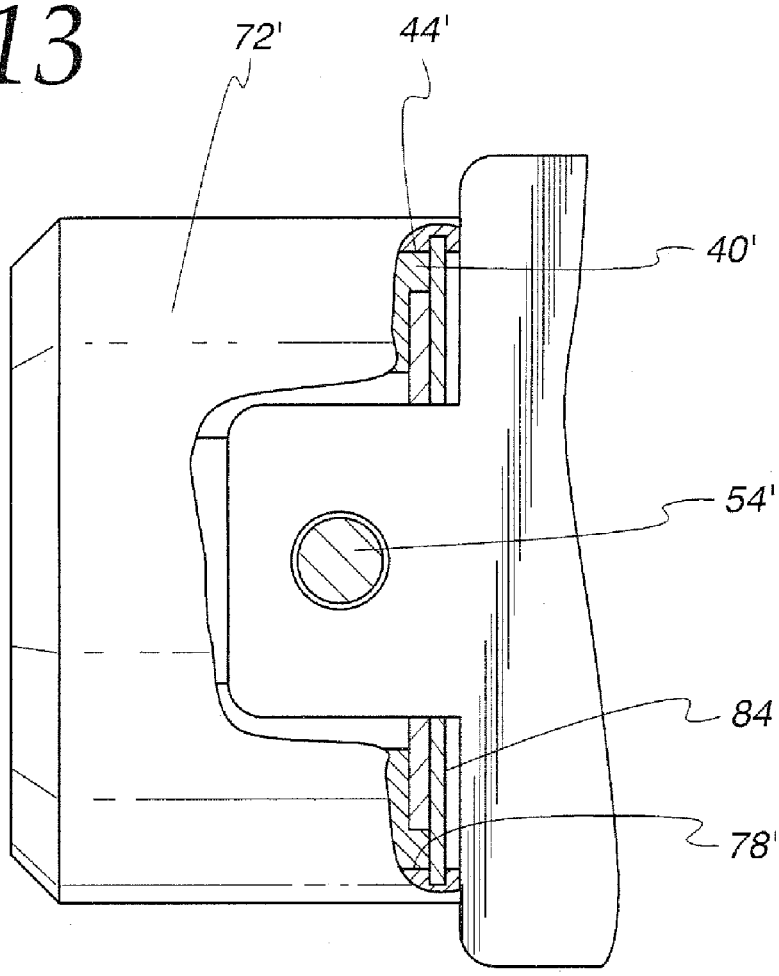
FIG. 13 is an enlarged, fragmentary, side elevation view of the lock assembly in FIGS. 9-12 with the lock assembly operatively positioned on the components shown in FIG. 3 and with a portion of the lock assembly broken away to show a bolt on the lock assembly extended through the components.
Figure 14:
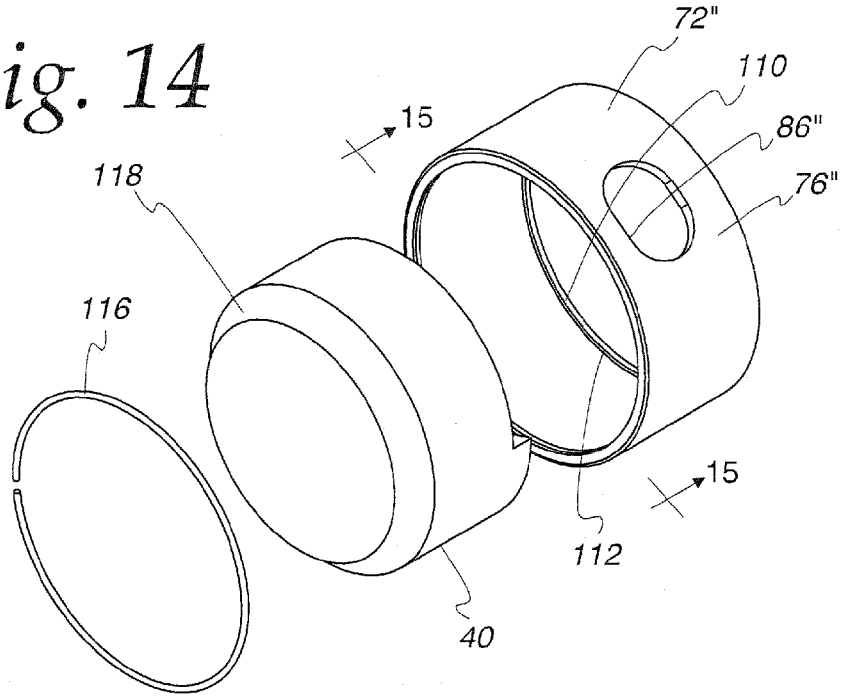
FIG. 14 is an exploded perspective view of a modified form of lock assembly, according to the present invention.
Figure 15:
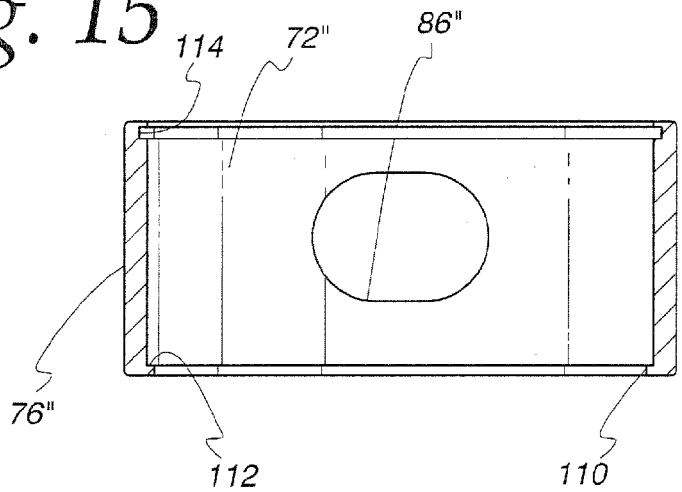
FIG. 15 is a cross-sectional view of a housing on the lock assembly taken along line 15-15 of FIG. 14.
Figure 24:
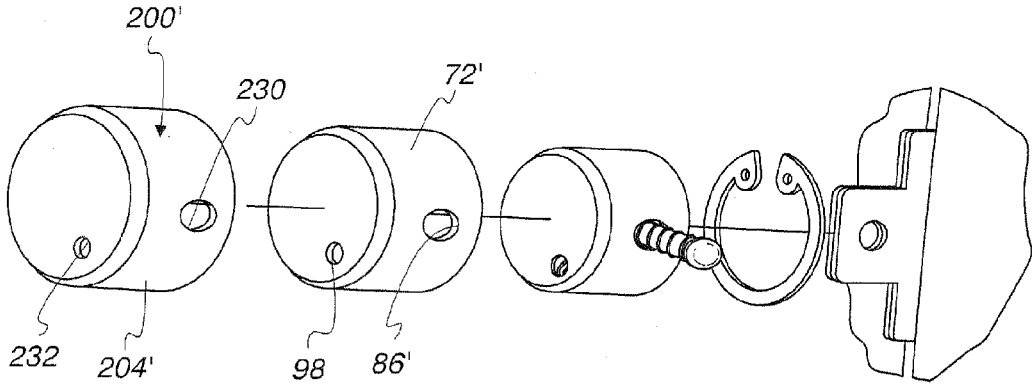
FIG. 24 is a view as in FIG. 10 and including a modified form of shielding assembly, according to the invention.

In FIG. 24, a modified form of the shielding assembly is shown at 200'. The shielding assembly 200' is shown with components as depicted in FIG. 10. The shielding assembly 200' has a body 204' that cooperates with the housing 72' in the same way that the body 204 cooperates with the housing 72. The primary difference with this embodiment is that the body has separate openings 230, 232 to cooperate, one each with the opening 86' and 98, respectively.

Figure 25:
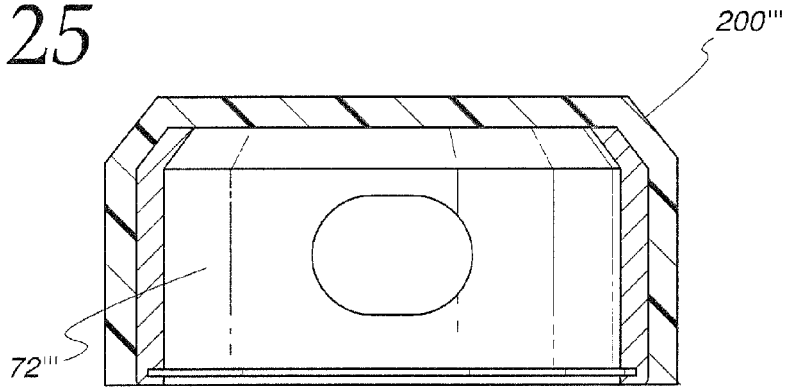
FIG. 25 is a view as in FIG. 17 and showing a further modified form of shielding assembly, according to the invention.

In FIG. 25, a further modified form of shielding assembly is shown at 200''' to cooperate with the housing 72''', as shown in FIG. 17.

Figure 26:
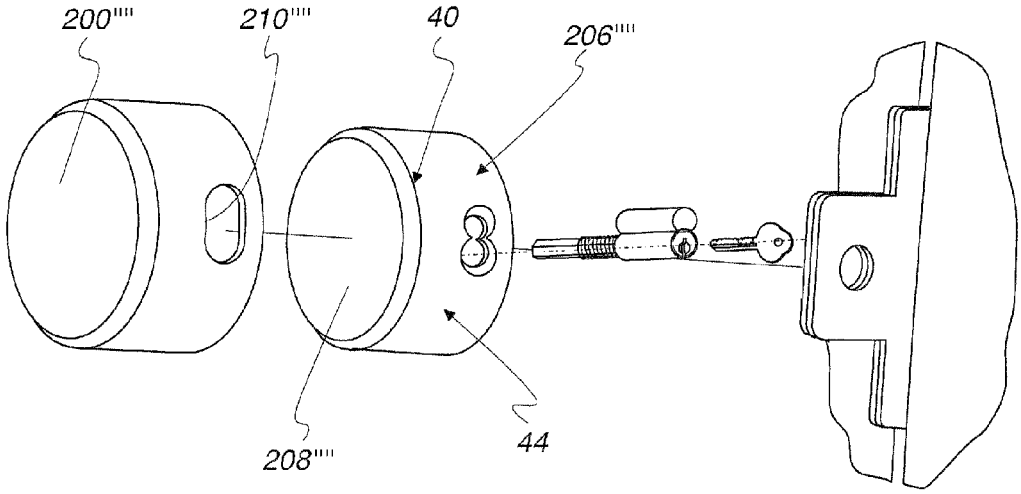
FIG. 26 is an exploded perspective view with certain components as shown in FIG. 5 and with a still further modified form of shielding assembly, according to the invention.
Figure 27:
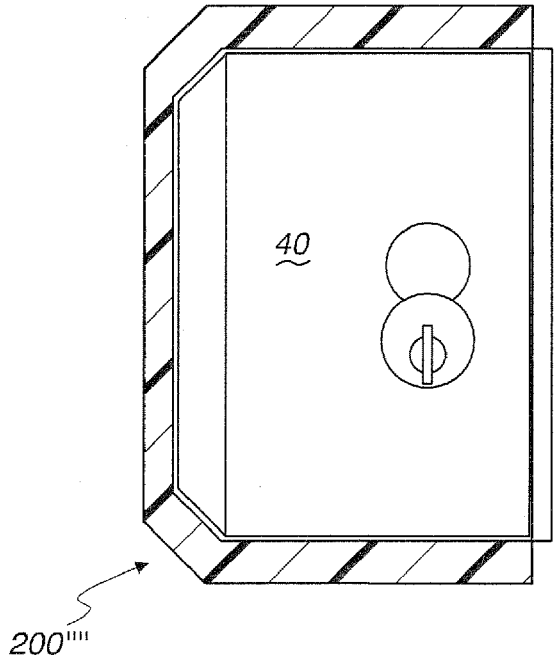
FIG. 27 is an enlarged, cross-sectional view of the components in FIG. 26 in an assembled state and with the shielding assembly in its operative state.

In FIGS. 26 and 27, a shielding assembly 200'''' is shown directly interacting with the casing 40, that does not have the aforementioned first assembly including the housing 72. In this case, the casing 40 has an external/outer surface 44, a corresponding first cylindrical surface portion 206'''', and a corresponding second surface portion 208'''' that interact with a cup-shaped internal surface 210'''' on the body 200'''' in the same way that the internal surface 210 cooperates with the surface portions 206, 208, as previously described.

The foregoing disclosure of specific embodiments is intended to be illustrative of the broad concepts comprehended by the invention.

The invention claimed is:

1. In combination:

an apparatus comprising a frame bounding an internal space and a first repositionable door that is movable between closed and open positions relative to the frame;

cooperating components on the first door and at least one of: a) the frame; and b) a second door that are alignable in a first relative position with the first door closed;

a lock assembly with an exposed outer surface, the lock assembly cooperating with the components with the first door in the closed position and the cooperating components in the first relative position and having a locked state wherein the lock assembly prevents the first door from being moved from its closed position into its open position; and a shielding assembly that conforms to at least a part of the exposed outer surface, overlies at least a part of the exposed outer surface, and is frictionally held against the lock assembly to be maintained in an operative state, wherein the exposed outer surface is made up of a first cylindrical surface portion with a central axis and a second surface portion through which the central axis extends that is generally flat and resides in a plane that is transverse to the central axis of the first cylindrical surface portion, wherein the shielding assembly comprises a body with a cup-shaped internal surface that nominally conforms to each of the first cylindrical surface portion and second surface portion.

2. The combination according to claim 1 wherein the body has a reconfigurable shape that is elastically deformed as the shielding assembly is placed in the operative state.

3. The combination according to claim 1 wherein the body has a reconfigurable shape.

4. The combination according to claim 3 wherein the body is made from at least one of a plastic and rubber material.

5. The combination according to claim 1 wherein the internal surface of the body frictionally engages the first cylindrical surface portion to maintain the shielding assembly in the operative state.

6. The combination according to claim 5 wherein the locking assembly comprises a casing that defines the first cylindrical surface portion and the second surface portion.

7. The combination according to claim 5 wherein the lock assembly comprises a casing with an external surface and a first assembly operatively joined to the casing so as to be movable relative to the casing, the first assembly extending over at least a portion of the external surface of the casing to block access to the casing in a manner that would allow a repositioning force to be applied to the external surface of the casing to thereby cause the cooperating components and/or the lock assembly and/or the apparatus to be reconfigured with the first door closed and the lock assembly in the locked state so that unauthorized access might be gained to the internal space by thereafter moving the first door from its closed position into its open position, the first assembly defining at least a part of the exposed outer surface that the shielding assembly overlies, and the shielding assembly overlies the exposed outer surface defined cooperatively by the casing and first assembly with the first assembly operatively ioined to the casing.

8. The combination according to claim 7 wherein the body is frictionally held against the part of the exposed outer surface that the shielding assembly overlies to maintain the shielding assembly in the operative state, the part of the exposed outer surface curved and extending around the central axis.

9. The combination according to claim 8 wherein the first assembly comprises at least one cover component that is guided for movement in a predetermined path relative to the casing and the cover component defines the part of the exposed outer surface that the shielding assembly overlies and to which the body of the shielding assembly is frictionally held.

10. The combination according to claim 9 wherein the at least one cover component comprises a housing that is guided for movement in the predetermined path relative to the casing around the central axis, wherein the lock assembly comprises a key-actuated operator that is operable to change the lock assembly between the locked state and an unlocked state and the housing has a first discrete opening to permit access by a key to the key-actuated operator and the body on the shielding assembly has a second discrete opening through which the first discrete opening is exposed.

11. The combination according to claim 10 wherein there is structure cooperating between the housing and body to consistently maintain the body in an operative orientation relative to the housing wherein the first discrete opening is exposed through the second discrete opening.

12. The combination according to claim 10 wherein there is indicia on an axially facing surface of the body that is viewable to identify angular orientation of the housing around the axis with the body in the operative orientation relative to the housing.

13. The combination according to claim 10 wherein there is structure cooperating between the housing and at least one of the apparatus, the cooperating components and a part of the lock assembly that releasably maintains the housing in a predetermined angular orientation around the axis.

14. The combination according to claim 13 wherein with the housing in the predetermined angular orientation, the first and second discrete openings open in a downward direction.

15. The combination according to claim 10 wherein the apparatus is a wheeled vehicle.

16. The combination according to claim 15 wherein the wheeled vehicle has an external surface with a first color and the body has a color selected to be coordinated with the first color.

17. The combination according to claim 1 wherein the cup-shaped internal surface opens axially and closely embraces the first cylindrical surface portion to maintain the shielding assembly in the operative state.

18. The combination according to claim 17 wherein the cup-shaped internal surface abuts to the second surface portion.

19. The combination according to claim 1 wherein an entirety of the exposed outer surface has an area and the shielding assembly overlies substantially all of the area of the exposed outer surface.

20. In combination:

an apparatus comprising a frame bounding an internal space and a first repositionable door that is movable between closed and open positions relative to the frame;

cooperating components on the first door and at least one of: a) the frame; and b) a second door that are alignable in a first relative position with the first door closed;

a lock assembly having a front and rear with the rear of the lock assembly closer to the doors than the front of the lock assembly, the lock assembly having an exposed outer surface with a first cylindrical surface portion with a central axis and a front surface portion through which the central axis extends, the lock assembly cooperating with the components with the first door in the closed position and the cooperating components in the first relative position and has a locked state wherein the lock assembly prevents the first door from being moved from its closed position into its open position; and a shielding assembly that conforms to at least a part of the exposed outer surface, overlies at least a part of the exposed outer surface portion and second surface portion, and is frictionally held against the lock assembly to be maintained in an operative state, the shielding assembly overlying the first cylindrical surface portion and front surface portion, wherein the exposed outer surface has an area and the shielding assembly overlies substantially all of the area of the exposed outer surface.

* * * * *